US010138027B2

(12) United States Patent
Burns

(10) Patent No.: US 10,138,027 B2
(45) **Date of Patent: *Nov. 27, 2018**

(54) PLUG FOR BEVERAGE CONTAINER LID

(71) Applicant: STIXTOGO, INC., Bothell, WA (US)

(72) Inventor: Thomas Burns, Bothell, WA (US)

(73) Assignee: StixToGo, Inc., Bothell, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/433,954

(22) Filed: Feb. 15, 2017

(65) Prior Publication Data

US 2017/0166359 A1 Jun. 15, 2017

Related U.S. Application Data

(63) Continuation of application No. 14/946,654, filed on Nov. 19, 2015, now abandoned, which is a (Continued)

(51) Int. Cl.
*B65D 39/16* (2006.01)
*B65D 39/00* (2006.01)
(Continued)

(52) U.S. Cl.
CPC ..... *B65D 39/16* (2013.01); *B01F 15/00681* (2013.01); *B65D 39/0005* (2013.01); *B65D 43/02* (2013.01); *B65D 51/18* (2013.01); *B65D 2251/009* (2013.01); *B65D 2251/0012* (2013.01); *B65D 2251/0028* (2013.01); *B65D 2251/0081* (2013.01); *B65D 2543/00046* (2013.01)

(58) Field of Classification Search
CPC ..... B65D 51/18; B65D 39/00; B65D 41/18; A47G 19/22; B01F 15/00
See application file for complete search history.

(56) References Cited

U.S. PATENT DOCUMENTS 1,014,486 A 1/1912 King
2,109,750 A 3/1938 Paul
(Continued)

FOREIGN PATENT DOCUMENTS

FR 2698773 6/1994
JP 2001-120414 5/2001

OTHER PUBLICATIONS

Office Action dated Jun. 4, 2007, from U.S. Appl. No. 11/323,824, filed Dec. 30, 2005.

(Continued)

*Primary Examiner* — Steven A. Reynolds
*Assistant Examiner* — Javier A Pagan
(74) *Attorney, Agent, or Firm* — Knobbe, Martens, Olson & Bear, LLP

(57) ABSTRACT

A device and system for temporarily sealing an orifice in a beverage container lid comprising a plug (10, 110, 210, 310) having an upper surface (14, 114, 214), a body portion (12, 112), and a lower surface (16, 116, 216), said body portion adapted to be inserted and releasably retained in the orifice to provide a temporary seal thereof, and an external member (20, 120, 220) located on the upper surface of the plug configured to allow a user to grip the plug for ease of removal from the orifice.

17 Claims, 6 Drawing Sheets

Related U.S. Application Data continuation of application No. 13/948,617, filed on Jul. 23, 2013, now Pat. No. 9,216,846, which is a continuation of application No. 12/901,423, filed on Oct. 8, 2010, now abandoned, which is a continuation of application No. 12/084,195, filed as application No. PCT/US2006/042620 on Oct. 31, 2006, now Pat. No. 8,052,003, which is a continuation of application No. 11/323,824, filed on Dec. 30, 2005, now abandoned.

(60) Provisional application No. 60/732,826, filed on Nov. 1, 2005.

(51) Int. Cl.

| | |
|---|---|
| ***B01F 15/00*** | (2006.01) |
| ***B65D 43/02*** | (2006.01) |
| ***B65D 51/18*** | (2006.01) |

(56) References Cited

U.S. PATENT DOCUMENTS

| | | | | |
|---|---|---|---|---|
| 2,462,991 | A | 3/1949 | Palinkas | |
| 2,723,111 | A | 11/1955 | Lawrence | |
| 2,841,307 | A | 7/1958 | Yoder | |
| 3,168,961 | A | 2/1965 | Yates | |
| 3,442,377 | A * | 5/1969 | Angelus | B65D 51/007 206/216 |
| 3,542,231 | A | 11/1970 | Wettermann et al. | |
| 3,545,980 | A | 12/1970 | Stanger | |
| 3,650,432 | A | 3/1972 | Easton et al. | |
| 3,871,547 | A | 3/1975 | Wharton | |
| 4,159,182 | A | 6/1979 | Adolfson | |
| D255,548 | S | 6/1980 | Grodin | |
| D256,721 | S | 9/1980 | Boller et al. | |
| 4,561,782 | A | 12/1985 | Jacobsen et al. | |
| 4,583,654 | A | 4/1986 | Pufpaff et al. | |
| D294,190 | S | 2/1988 | Aquarius | |
| 4,823,978 | A | 4/1989 | Pufpaff | |
| 4,903,855 | A | 2/1990 | Ducay et al. | |
| 5,038,476 | A | 8/1991 | McCrea | |
| D322,370 | S | 12/1991 | Cross et al. | |
| 5,894,952 | A * | 4/1999 | Mendenhall | A47G 19/2272 215/230 |
| 5,938,325 | A | 8/1999 | Edwards | |
| 5,996,837 | A | 12/1999 | Freek et al. | |
| D421,570 | S | 3/2000 | Hollinger | |
| 6,032,694 | A | 3/2000 | Wellen et al. | |
| D422,214 | S | 4/2000 | Hollinger | |
| 6,132,125 | A | 10/2000 | Lin | |
| 6,305,832 | B1 | 10/2001 | Huang | |
| D451,337 | S | 12/2001 | Sum | |
| 6,638,131 | B1 | 10/2003 | Thai | |
| 6,644,490 | B2 | 11/2003 | Clarke | |
| 6,871,995 | B2 | 3/2005 | Simba | |
| 6,886,707 | B2 | 5/2005 | Giraud | |
| D520,359 | S | 5/2006 | Sach | |
| 7,100,787 | B2 | 9/2006 | Farnsworth et al. | |
| 7,244,161 | B2 * | 7/2007 | Thai | A63H 33/28 215/388 |
| D590,650 | S | 4/2009 | Aoki et al. | |
| 7,584,900 | B2 | 9/2009 | White et al. | |
| D619,428 | S | 7/2010 | Saha et al. | |
| D632,571 | S | 2/2011 | Blythe | |
| D640,561 | S | 6/2011 | Seys | |
| D643,719 | S | 8/2011 | Chiott | |
| 8,052,003 | B2 | 11/2011 | Burns | |
| D659,465 | S | 5/2012 | Burns | |
| D660,077 | S | 5/2012 | Burns | |
| D673,809 | S | 1/2013 | Burns | |
| D705,592 | S | 5/2014 | Burns | |
| 9,216,846 | B2 * | 12/2015 | Burns | B65D 39/0005 |
| 2003/0089714 | A1 | 5/2003 | Dart et al. | |
| 2004/0031797 | A1 | 2/2004 | Farnsworth et al. | |
| 2004/0094549 | A1 | 5/2004 | Ryan et al. | |
| 2005/0189352 | A1 | 9/2005 | Deley | |
| 2005/0284874 | A1 | 12/2005 | Lucks | |
| 2006/0278653 | A1 | 12/2006 | Zeyfang et al. | |
| 2007/0007292 | A1 | 1/2007 | Deley et al. | |
| 2007/0023442 | A1 | 2/2007 | Auzenne | |
| 2007/0095833 | A1 | 5/2007 | Burns | |

OTHER PUBLICATIONS

International Search Report and Written Opinion dated Jun. 21, 2007, from International Patent Application No. PCT/US2006/042620, filed on Oct. 31, 2006.

* cited by examiner

PLUG FOR BEVERAGE CONTAINER LID

CROSS-REFERENCE TO RELATED APPLICATIONS

This application is a continuation of U.S. patent application Ser. No. 14/946,654, filed on Nov. 19, 2015, which is a continuation of U.S. patent application Ser. No. 13/948,617, filed on Jul. 23, 2013 (now U.S. Pat. No. 9,216,846), which is a continuation of U.S. patent application Ser. No. 12/901,423, filed on Oct. 8, 2010, now abandoned, which is a continuation of U.S. patent application Ser. No. 12/084,195, filed Apr. 25, 2008 (now U.S. Pat. No. 8,052,003), which is a U.S. National Phase Application of PCT International Application Number PCT/US2006/042620, filed on Oct. 31, 2006, designating the United States of America and published in the English language, which is an International Application of and claims the benefit of priority to U.S. application Ser. No. 11/323,824, filed on Dec. 30, 2005, and U.S. Provisional Patent Application No. 60/732,826, filed on Nov. 1, 2005. Each of the above-referenced patents and applications are hereby expressly incorporated by reference in their entirety.

FIELD OF THE INVENTION

This invention relates to the field of beverage containers and, more particularly, to plugs for sealing the lids of beverage containers.

BACKGROUND OF THE INVENTION

Many beverages are sold from bulk or as single serving preparations, and dispensed into beverage containers, which are usually in the form of plastic or paper cups. Numerous different types of lids have been used for such containers, and, in addition to providing a thermal barrier to maintain the serving temperature, the lids are intended to retain the beverage in the container when the container is transported or is accidentally disturbed. Commonly, such lids will also provide an orifice in the upper surface, allowing the beverage to be consumed without removing the lid. Such containers and such lids are commonly single-use disposable items and, accordingly, must be capable of being produced at a low cost.

A typical lid for such a beverage container is formed from thin plastic sheet material, for example by vacuum forming, and comprises a top panel, either flat or domed, with a downwardly depending peripheral rim. The plastic material of the lid is typically somewhat flexible and resilient so that the lid can be fitted over the open end of a suitably sized beverage container. The rim of the lid grips the rim of the open end of the container, and the beverage is then retained within the container. The orifice is commonly provided in the outer portion of the top panel, or in the dome of domed lids. Unfortunately, this orifice reduces the effectiveness of the thermal barrier, and provides an opening through which the beverage can spill should the container be accidentally disturbed.

Thus, it is considered desirable to provide a low cost device that enables the orifice to be temporarily plugged, and thus increase the efficiency of the thermal barrier, while also increasing the security of the beverage during transportation of the container. If desired, a number of additional functions can be incorporated into such a device as well.

SUMMARY OF THE INVENTION

The present invention provides a device and system for temporarily sealing an orifice in a beverage container lid.

In one aspect, the device comprises a plug having an upper surface, a body portion and a lower surface. The body portion is adapted to be inserted and releasably retained in the orifice of the lid to provide a temporary seal thereof. The device also includes an external member located on the upper surface of the plug configured to allow a user to grip the plug for ease of removal from the orifice.

In another aspect, the system of the present invention comprises a container for containing a liquid beverage having an open end, a lid having at least one orifice and configured to attach to the open end of the container, and a plug for temporarily sealing the orifice in the beverage container lid. The plug comprises an upper surface, a body portion and a lower surface. The body portion is adapted to be inserted and releasably retained in the orifice of the lid to provide a temporary seal thereof. The device also includes an external member located on the upper surface of the plug configured to allow a user to grip the plug for ease of removal from the orifice.

Other and further aspects of the invention will be readily apparent from the following drawings and detailed description.

DETAILED DESCRIPTION OF THE PREFERRED EMBODIMENT

The present invention provides a device and system for temporarily sealing an orifice in a beverage container lid.

In one aspect, the device comprises a plug having an upper surface, a body portion and a lower surface. The body portion is adapted to be inserted and releasably retained in the orifice of the lid to provide a temporary seal thereof. The device also includes an external member located on the upper surface of the plug configured to allow a user to grip the plug for ease of removal from the orifice.

Most often, the present device will be configured to meet the requirements of a conventional lid for such a beverage container, each of which are most commonly circular in horizontal cross section. Such lid will typically be formed from thin plastic sheet material, for example by vacuum forming, and including a top panel, either flat or domed, with a downwardly depending peripheral rim. The plastic material of the lid is typically somewhat flexible and resilient, as is the rim of the open end of the container, so that the lid can be fitted over the open end of a suitably sized beverage container. The rim of the lid then grips the rim of the open end of the container, whereby the beverage is retained within the container. The orifice of the lid is commonly provided in the outer portion of the top panel, near the depending peripheral rim, or in the dome or domed lids. Less commonly, lids for beverage containers are also available with a flap that is pressed down (or lifted up) to open the orifice in the lid.

Thus, in another aspect, the system of the present invention comprises a container for containing a liquid beverage having an open end, a lid having at least one orifice and configured to attach to the open end of the container, and a plug for temporarily sealing the orifice in the beverage container lid. The plug comprises an upper surface, a body portion and a lower surface. The body portion is adapted to be inserted and releasably retained in the orifice of the lid to provide a temporary seal thereof. The device also includes an external member located on the upper surface of the plug configured to allow a user to grip the plug for ease of removal from the orifice.

Figure 1:
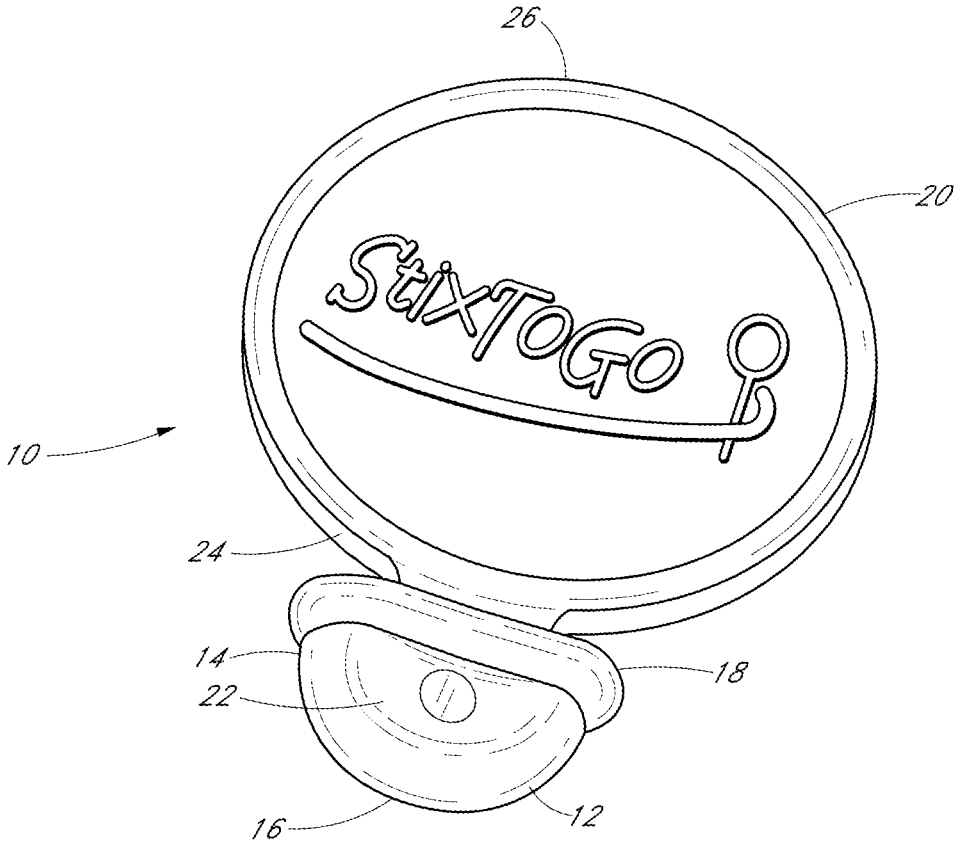
FIG. 1 is a perspective view of one embodiment of the invention depicting the plug including the body portion, the optional cap, and the external member.

Turning now to the several figures of the drawing, where like elements are identified by like numerals and corresponding or equivalent elements are identified by corresponding numerals throughout the figures, FIG. 1 shows a plug device 10 including a body portion 12 adapted to be inserted and releasably retained in the orifice of a beverage container lid to provide a temporary seal thereof. Plug 10 also includes an upper surface 14 and a lower surface 16, and, optionally, a "cap" feature 18 on the upper surface 14. Also depicted as extending from upper surface 14 is an external member 20 to provide a feature allowing the user of plug 10 to more easily grip the plug for insertion and removal from the orifice of the lid.

Figure 2:
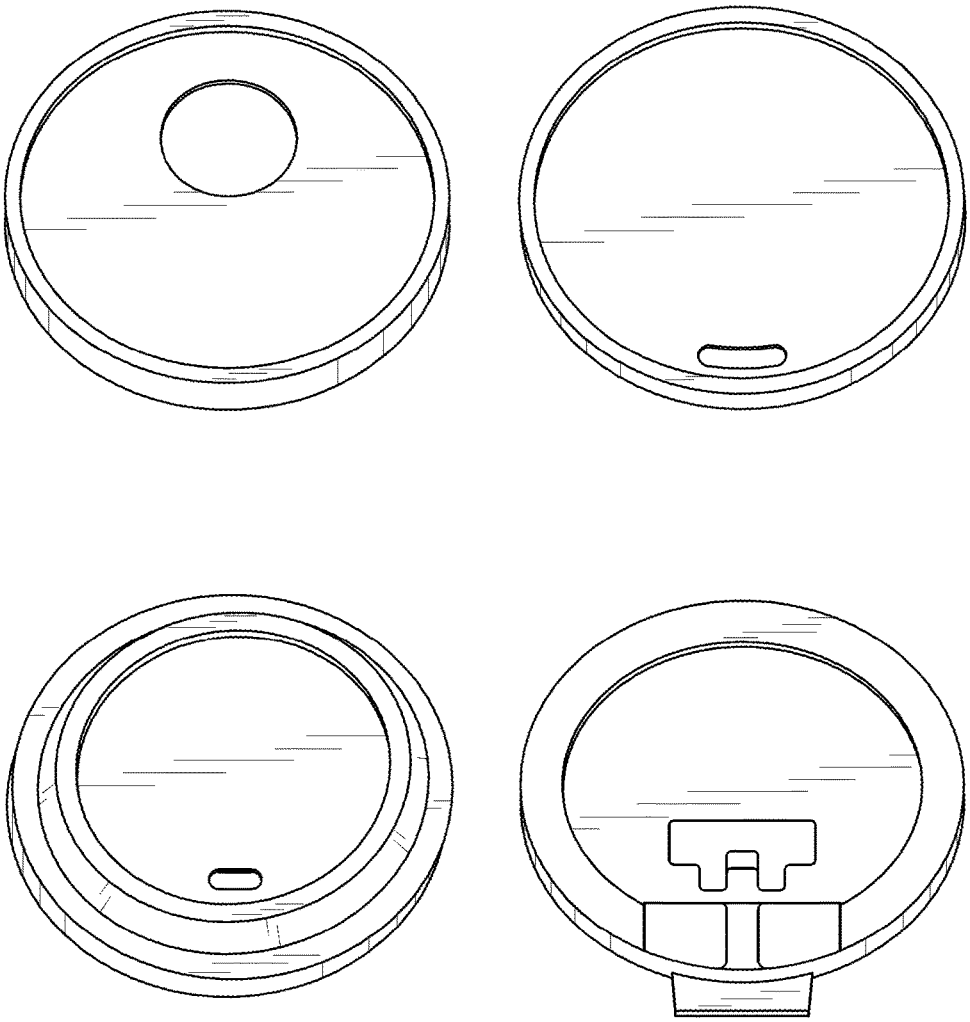
FIG. 2 (PRIOR ART)
FIG. 2 is a top plan view of a number of conventional beverage container lids, depicting various conventional orifices in accordance with the prior art.

In preferred embodiments of the invention, body portion 12 of plug 10 will be shaped so that the horizontal cross section of body portion 12 approximates the shape of the orifice in the beverage container lid, so as to provide an interference fit in the orifice. As depicted in FIG. 2, one common shape employed for the orifice of a conventional beverage container lid is best described as "sausage-shaped" in which the ends are roughly hemi-circular, and the middle portion is curved, for example to somewhat approximate the curve of the outer edge of the top panel of the lid, thus providing a convenient way to consume the beverage without resort to removing the lid. Alternatively, another common shape employed for such an orifice is best described as an "oval-shaped" orifice in which the ends are roughly hemi-circular, and the middle portion is relatively linear, suggestive of a motorsports racetrack oval. Less commonly, the orifice will be generally circular in shape, but more significantly, the orifice is always substantially smaller in size than the lid and the open end of the beverage container. By substantially smaller it is meant that the area of the orifice is typically less than approximately 50 percent of the area of the lid, more commonly less than approximately 20 percent, and most commonly in the range of from approximately 0.2 percent to approximately 10 percent of the area of the lid. Thus, the horizontal cross-sectional dimensions of the present body portion 12 will be substantially smaller than those of the lid and the open end of the beverage container, and will most often be of a different shape as well.

In lids for beverage containers having a flap that is pressed down (or lifted up) to open the orifice in the lid, the orifice is more often shaped as an oblong, or a three- or four-sided opening. Clearly, numerous alternative shapes exist for the orifice, and the present plug need only have a body portion that approximates such shape, or an appropriately designed cap feature, in order to incorporate the desired sealing function.

As will be seen from FIG. 1, the upper surface of the plug body will typically, but not necessarily, be flat, or optionally "capped" with a shaped cap feature 18 that exceeds the horizontal cross-sectional dimensions of the body portion 12. This cap feature 18 can serve a number of functions, including providing a limit to the insertion of plug 10 into the orifice, additional sealing of the orifice to inhibit leaking of the beverage, and the like. Alternatively, or in addition, the upper surface 14 of the body portion 12 can be shaped to match some design characteristic of the external member 20.

The body portion 12 of plug 10 will desirably, but not necessarily, include a taper, narrower at the lower surface 16 and wider at the upper surface 14, so as to facilitate the insertion and retention of plug 10 in the orifice. In certain embodiments, the sidewalls 22, 22' (not shown) of the body portion 12 can be recessed, in order to simplify insertion of plug 10 into the orifice. In such embodiments, optional cap feature 18 of upper surface 14 will provide much if not all of the sealing function of plug 10. In certain other embodiments, body portion 12 can include a circumferential depression, located at an appropriate point below the upper surface 14 where the body portion 12 is slightly over-sized to the lid orifice, and configured to provide a "snap-fit" when plug 10 is inserted into the lid orifice, and thus increase the security and retention of plug 10 in the orifice. However, care should be taken to avoid too tight of a fit between plug 10 and the orifice, as an excessively tight fit would make it difficult for the user to remove plug 10 for consumption of the beverage without removing the lid at the same time.

The present plug device will be formed from any acceptable material, such as plastic, resin or metal, and the like, and the body portion of the plug can be solid or hollow, so as to reduce weight or to provide additional functionalities. In embodiments in which the body portions are at least partially hollow, the lower surface can also be open to the interior of the beverage container, while preserving the sealing function.

As will be seen in FIG. 1, external member 20 located on upper surface 14 of plug 10 will include proximal 24 and distal regions 26, and can assume any desired shape. In certain preferred embodiments, external member 20 can be shaped in the form of a flat polygon or disk or the like, which would provide a convenient grip for the user of the plug, and allow the placement of displays or messages and/or images, such as logos, advertising messages, promotions and the like, on either or both of the flat surfaces 28, 28' (not shown) of the external member 20, either by molding, embossing, printing, applying labels, and the like. Alternatively, external member 20 can assume a free-form shape, take the shape of an advertising logo or other insignia deemed attractive to the beverage seller or the beverage consumer. The precise size and shape of external member 20 is not deemed critical to its ability to perform the intended function(s). However, for ease of use for displays, such as advertising and the like, the flat sides of a preferred external member 20 as described above will generally range in size from approximately 0.5 to approximately 15 square centimeters, more commonly from approximately 1 to approximately 10 square centimeters, in order to provide sufficient space for the display and to facilitate the legibility thereof. Of course, it is also within the scope of the present invention to formulate such displays in a more technologically sophisticated manner, such as lighted or scrolling displays employing, for example, light emitting diodes and/or liquid crystal displays, and the like. Naturally, such more sophisticated displays would likely increase the per unit cost of the present invention.

The lower surface 16 of the plug 10 can be rounded, as depicted in FIG. 1, or it can be truncated so as to approximate the cross-sectional shape of the body portion 12, or any desired alternative form. Alternatively, as disclosed above, lower surface 16 can be recessed, for example where body portion 12 is at least partially hollow.

Figure 3:
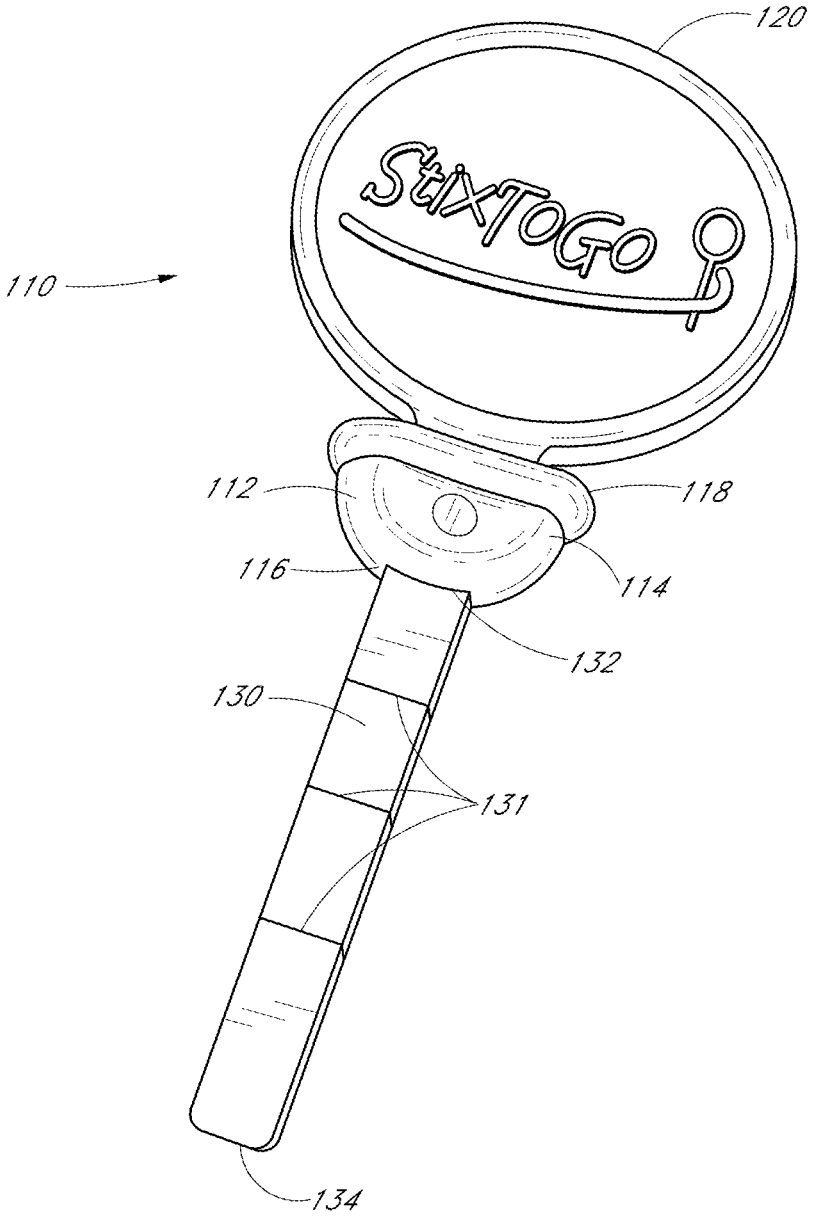
FIG. 3 is a perspective view of an alternative embodiment of the invention depicting the plug including the body portion, the optional cap, the external member, and the optional elongate projection.
Figure 6:
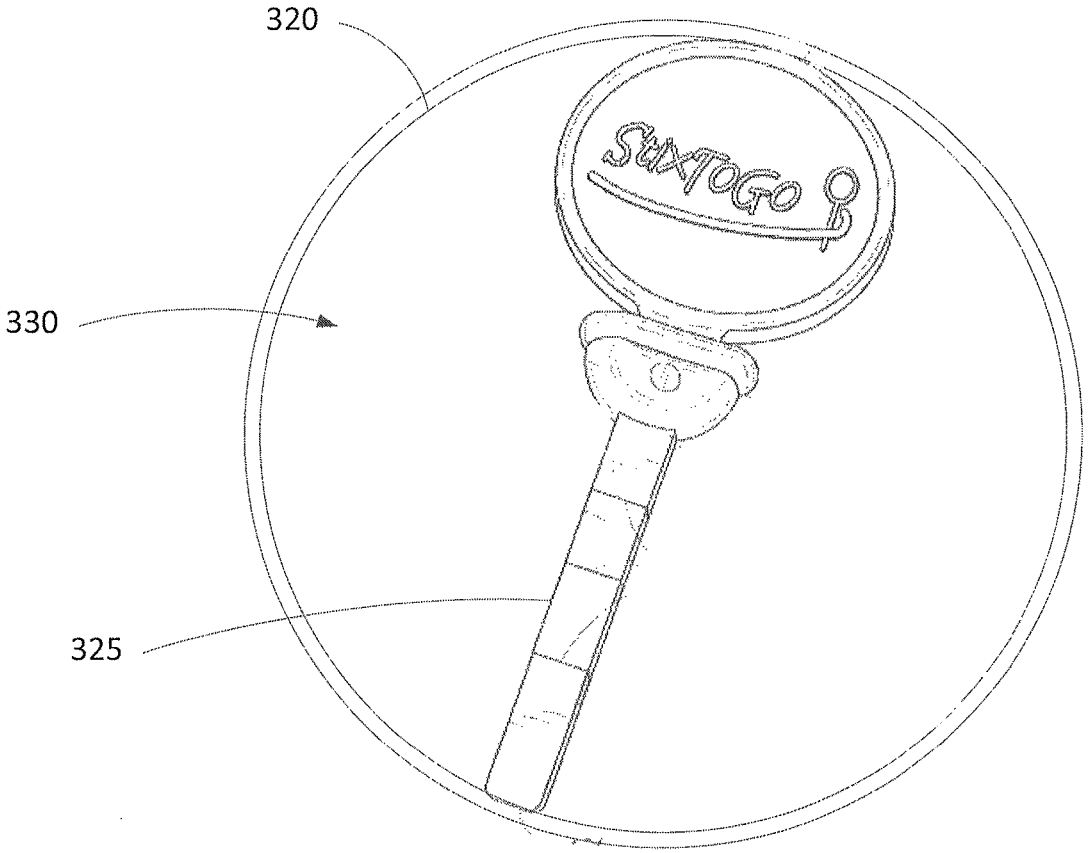
FIG. 6 illustrates a plug fit into a recess on the bottom of a beverage container.

Optionally, as depicted in FIG. 3, lower surface 116 of plug 110 can be shaped to include an elongate projection 130 depending downwardly, thus having proximal 132 and distal 134 ends, so as to provide for example a means to stir the beverage, similar to a conventional stir-stick as often included as a separate item with containers of coffee and other similar beverages. The elongate projection 130 can be of any reasonable length, but the overall length will be limited by the height of the beverage container and the amount of body portion 112 that projects below the lid when plug 110 is inserted into the lid orifice. One convenient length for the present plug (e.g. plug 110) is a dimension that will allow the plug to be fitted into the beverage container and/or lid for packaging as a unit, such as with the system of the present invention. For example, typical beverage containers could be packaged with a plug inside, for ease of shipping and storage. Further, typical beverage containers often include a rim 320 (FIG. 6) around the bottom, and the present plug 325 FIG. 6 could be sized to fit into the recess 330 (FIG. 6) created by such a rim 320, so that it is outside the container but packaged in conjunction. In such embodiments, the present plug would desirably be size to fit so that the diametrically opposed edges of the rim fit against the plug 325, thus retaining the plug in a loose interference fit. Elongate projection 130 can also be provided with any convenient width, typically somewhat less than the width of the body portion 112 of the plug 110, and any convenient cross section, such as substantially circular, substantially oval, substantially quadrilateral, and substantially polygonal cross sections, and the like, while retaining the stirring functionality.

As shown in FIG. 3, a further optional feature of the elongate projection 130 is the possible inclusion of one or more "score lines" or grooves 131 aligned approximately with the width of the projection at pre-selected locations along the length of the projection. Each such score line will provide a convenient point at which to break off an unwanted portion of the elongate projection 130 to adjust the length of the projection to meet certain requirements (such as adjusting the length to adapt to different size beverage containers, shortening or removing the projection after use, and the like). The placement and configuration of optional score line(s) 131 will be determined to meet individual requirements, and in particular, the configuration of each score line 131 will be determined in part by the desire to avoid inadvertent breakage while facilitating intentional breakage. For example, the depth and shape of any particular score line 131 will often be dictated by considerations involving ease of manufacture and the selected material used to form the plug 10, so that breaking the elongate projection 130 at the particular score line 131 will involve purposeful but not undue effort.

Figure 4:
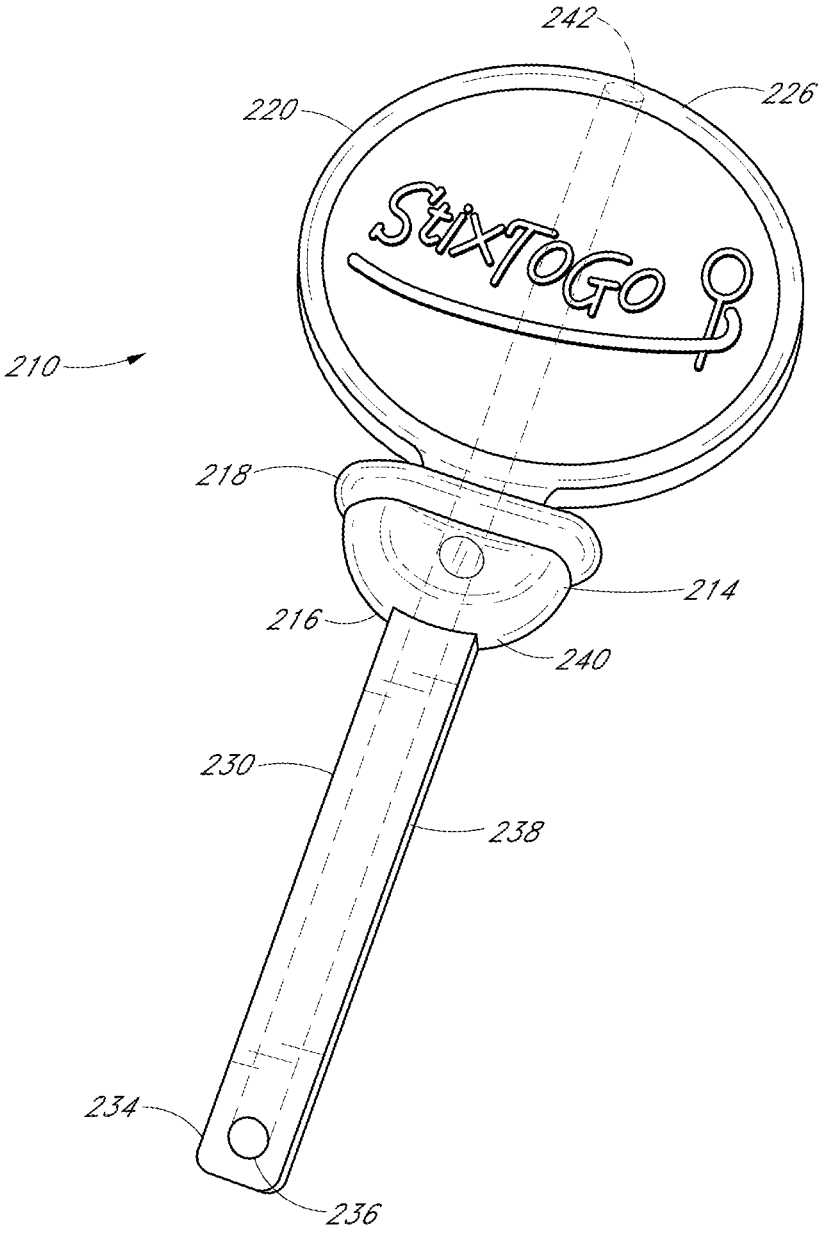
FIG. 4 is a perspective view of yet another alternative embodiment of the invention depicting the including the body portion, the optional cap, the external member, the optional elongate projection and a channel for removing liquid from the beverage container.

In addition, as depicted in FIG. 4, elongate projection 230 can be hollow, if desired to reduce weight, or to provide an additional functionality as a straw. In such embodiments, the projection will typically extend sufficiently to approach the bottom of the beverage container, and include an opening 236 at or near the distal end 234, so as to provide access to the beverage in the container. This elongate projection 230 will then comprise a channel 238, which communicates with a hollow region 240 in plug 210, and thence lead through external member 220 to a complementary opening 242, thus completing channel 238 to allow the user to gain access to the beverage in the container without removing either the lid or plug 210. This opening 242 can be located at or near the distal region 226 of external member 220, for example, in the upper rim of a disk-shaped external member, or in any convenient location.

One alternative for inclusion of such an access feature (and a stirring function) in the present plug 10, 110, 210 is to form a channel 238 between the upper 14, 114, 214 and lower 16, 116, 216 surfaces of the plug, optionally also though or opening alongside external member 20, 120, 220, and an optional elongate projection 130, 230, which channel is configured to allow the insertion of a straw, such as a conventional plastic straw as used for serving beverages in commercial environments, in a close but slideable relationship with the plug 10, 110, 210. This optional included straw could then also provide the stirring functionality of the elongate projection 130, 230 and simplify the adjustment of the length, by sliding relative to the plug 10, 110, 210 and thus allowing an adjustable length straw/elongate projection to adapt to particular beverage containers.

Alternatively, or in addition, the distal end 134, 234 of the elongate projection 130, 230 can be shaped as a paddle, or a scoop, or any alternative shape that can improve its functionality, or provide additional functionality beyond those already described herein. Such improvements will readily occur to those having access to the present description of the invention.

Figure 5:
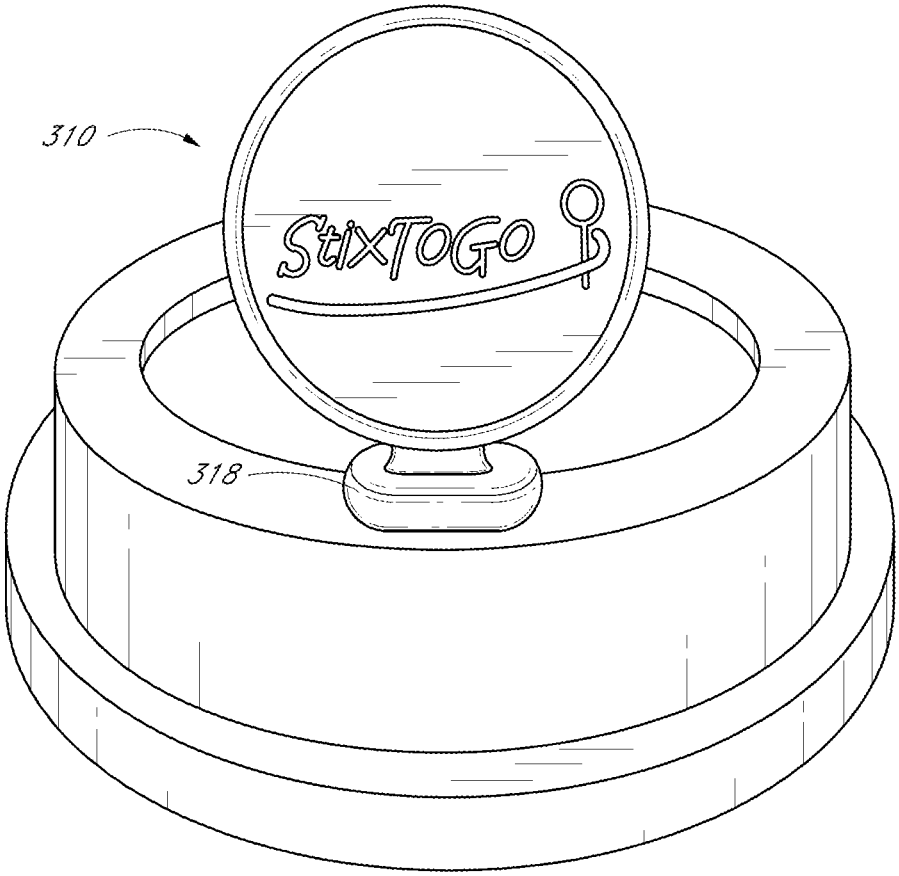
FIG. 5 is a graphic representation of yet another alternative embodiment of the invention depicting the plug and the external member while the device is in situ in the orifice of a beverage container lid.

FIG. 5 depicts one representative embodiment of a plug 310 of the present invention that has been inserted into the orifice of a conventional beverage container lid, and showing the use of the optional cap 318 to provide an additional sealing function for plug 310.

In most embodiments of the present invention, the plug, the external member and the optional elongate projection will be monolithic, that is, formed or fabricated as a single piece, typically as a unitary article from the same material and at the same time. Typically, in order to produce the present plugs at the lowest cost, some form of molding process will be employed, and the plugs will typically be fabricated from some form of plastic material, all in accordance with means routinely known and/or employed in such fabrications, either presently or in the future.

Alternatively, the present plugs can be formed of, for example, metal, epoxy resin, and other similar durable materials, also in accordance with means routinely known and/or employed in such fabrications, either presently or in the future. Such plugs will be expected to be better able to endure the rigors of re-use, storage in the user's pocket or on a key-chain, or the like. Such plugs can readily be envisioned as taking on various attributed of fine jewelry, for example in the fabrication materials and/or elements of ornamentation. In embodiments of the present plug that are intended to be stored on a key-chain for example, it would be considered desirable to incorporate a "quick-release" feature to separate the plug from the key-chain, and again such quick-release features are well known and readily adaptable to use with the present invention.

Although the foregoing invention has been described in some detail by way of illustration and example for purposes of clarity and understanding, it will be apparent to those of ordinary skill in the art in light of the disclosure that certain changes and modifications may be made thereto without departing from the spirit or scope of the appended claims.

What is claimed is:

1. A beverage container packaging system, for temporarily sealing a drinking orifice in a lid of a beverage container, comprising:

a beverage container having a rim around the bottom of the container, the rim creating a recessed area outside of the container and on the bottom of the container; and a plug comprising a body portion having an upper surface, a lower surface, and a cap portion disposed on the upper surface, the cap portion configured such that the cap portion's cross-sectional dimension exceeds the cross-sectional dimension of the body portion to provide a limit to the insertion of the plug into the orifice;

a first sidewall disposed between the upper surface and the lower surface of the body portion, and a second sidewall disposed between the upper surface and the lower surface of the body portion, the first and second sidewalls disposed on opposite sides of the body portion, the first sidewall having a first circumferential depression located in the sidewall; and an elongate projection of uniform width extending from the lower surface to a length sized such that the plug fits inside the rim and within the recess of the beverage container.

2. The system of claim 1, additionally comprising a second circumferential depression located in the second sidewall.

3. The system of claim 2, wherein the elongate projection extends from the lower surface 0-30 millimeters.

4. The system of claim 2, wherein the elongate projection extends 30 millimeters from the lower surface.

5. The system of claim 2, wherein the elongate projection is sized such that when the plug is inside the recess, the plug fits against two diametrically opposed edges of the rim around the bottom of the beverage container to create a loose interference fit.

6. The system of claim 2, wherein the first and second circumferential depressions are configured to retain the plug within the orifice.

7. The system of claim 2, wherein the first and second circumferential depressions are configured to provide a snap-fit when the plug is inserted into the orifice.

8. The system of claim 2, wherein the body portion and the cap portion are fabricated as a unitary article from the same material.

9. The system of claim 2, wherein the first and second sidewalls are configured to engage at least a portion of the orifice.

10. The system of claim 2, further comprising an external member disposed on the cap portion, the external member configured to allow a user to grip the plug.

11. The system of claim 1, further comprising an external member disposed on the cap portion, the external member configured to allow a user to grip the plug.

12. The system of claim 1, wherein the elongate projection extends 30 millimeters from the lower surface.

13. The system of claim 1, wherein the elongate projection extends from the lower surface between 0-30 millimeters.

14. The system of claim 1, wherein the elongate projection is sized such that when the plug is inside the recess, the plug fits against two diametrically opposed edges of the rim around the bottom of the beverage container to create a loose interference fit.

15. The system of claim 1, wherein the first circumferential depression is configured to provide a snap-fit when the plug is inserted into the orifice.

16. The system of claim 1, wherein the body portion and the cap portion are fabricated as a unitary article from the same material.

17. The system of claim 1, wherein the first and second sidewalls are configured to engage at least a portion of the orifice.

* * * * *